US005083810A

United States Patent [19]

Minidis

[11] Patent Number: 5,083,810

[45] Date of Patent: Jan. 28, 1992

[54] DOUGLE EDGE SNOW SKI

[76] Inventor: James D. Minidis, 4515 Paseo Bravo, Palmdale, Calif. 93551

[21] Appl. No.: 643,510

[22] Filed: Jan. 22, 1991

[51] Int. Cl.[5] ..... A63C 5/048

[52] U.S. Cl. ..... 280/608

[58] Field of Search ..... 280/608, 609, 610

[56] References Cited

U.S. PATENT DOCUMENTS

| | | | |
|---|---|---|---|
| 2,259,327 | 10/1941 | Serr | 280/608 |
| 3,871,671 | 3/1975 | Bildner | 280/608 |
| 3,944,239 | 3/1976 | Hastings et al. | 280/608 |

FOREIGN PATENT DOCUMENTS

| | | | |
|---|---|---|---|
| 2403944 | 8/1975 | Fed. Rep. of Germany | 280/608 |
| 2720766 | 11/1978 | Fed. Rep. of Germany | 280/608 |
| 2595953 | 9/1987 | France | 280/608 |

*Primary Examiner*—David M. Mitchell
*Attorney, Agent, or Firm*—Kelly Bauersfeld & Lowry

[57] ABSTRACT

A snow ski is provided with a pair of relatively sharp turning edges extending along each of the lateral sides thereof for improved performance during turning maneuvers. The snow ski includes edge runners extending along the lateral sides thereof with each edge runner defining the pair of sharp turning edges spaced laterally and vertically with respect to each other, and extending longitudinally along the associated lateral side of the ski. During a turning maneuver, the skier may by appropriate tilting of the ski engage one or both edges at one lateral side of the ski with the snow surface to variably select the degree of turning control.

4 Claims, 2 Drawing Sheets

DOUGLE EDGE SNOW SKI

BACKGROUND OF THE INVENTION

This invention relates generally to improvements in snow skis particularly with respect to providing improved ski performance during turning maneuvers. More specifically, this invention relates to an improved snow ski having double turning edges.

In the sport of snow skiing, turning maneuvers are accomplished by tilting one or both skis to engage a relatively sharp lateral ski edge with the snow surface, resulting in a gripping action between the ski and the snow. When this gripping or edging action occurs in combination with appropriate skier body position, relatively sharp and rapid turning maneuvers can be performed. However, the effective gripping action between the ski and the snow can be limited when the snow surface exhibits significant ice characteristics. Alternatively, novice skiers often possess insufficient skills to insure consistent edging action in the course of attempted turning maneuvers. As a result, the gripping action between the ski and the snow surface is often inadequate such that the skier must reduce speed and/or reduce turning angles, or otherwise risk falling.

The present invention provides an improved snow ski adapted for significantly enhanced gripping or edging action with a snow surface, thereby permitting improved turning maneuver performance.

SUMMARY OF THE INVENTION

In accordance with the invention, an improved snow ski is provided for achieving significantly improved gripping or edging action between the ski and snow surface throughout various turning movements. In general terms, the improved snow ski includes a pair of relatively sharp turning edges extending longitudinally along each of the lateral sides thereof, wherein these double turning edges significantly increase gripping or edging action between the ski and the snow surface.

In the preferred form, the improved snow ski includes an elongated edge runner extending along each of the lateral sides thereof and shaped to define the pair of relatively sharp turning edges. The edge runner preferably comprises an edge strip mounted along the lower and laterally outer sides of the ski for engaging the snow surface when the ski is tilted with respect to the snow surface during a turning maneuver. The preferred edge runner includes the twin edges at positions spaced laterally and vertically with respect to each other, with a lower first edge disposed inwardly and vertically below a second upper edge. These twin edges may be formed to extend along the entire lateral sides of the ski, or otherwise shaped to extend over selected portions thereof, such as a central region generally adjacent to a boot binding structure.

In use, when the ski is tilted with respect to the snow surface during a turning maneuver, the lower first edge at one side of the ski is oriented for gripping edging action with the snow surface. A small degree of additional tilting motion orients the ski with both edges engaging the snow surface. Accordingly, depending upon the skill and skiing technique of a particular skier, the degree of edging control during a turning maneuver may be variably selected.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
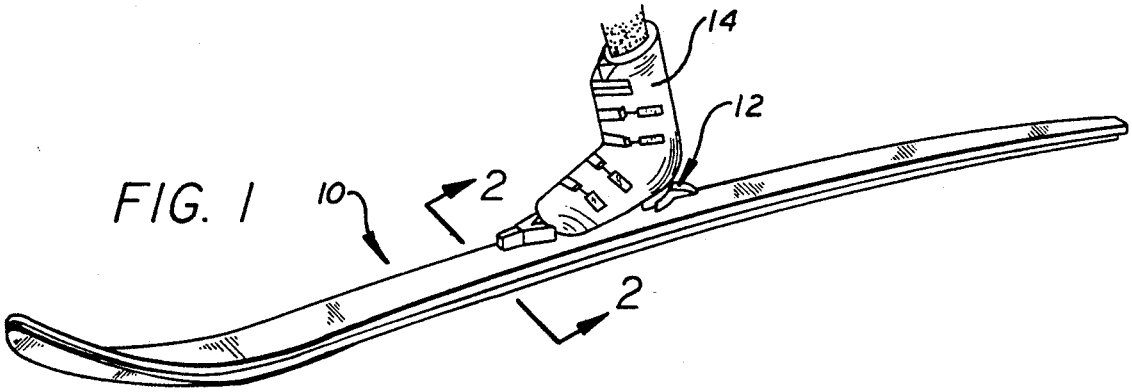
FIG. 1 is a perspective view illustrating a double edge snow ski embodying the novel features of the invention.

As shown in the exemplary drawings, an improved snow ski referred to generally in FIG. 1 by the reference numeral 10 is provided for improved performance during turning maneuvers. The snow ski 10 incorporates double turning edges which extend along each lateral side of the ski and provide improved gripping or edging engagement with a snow surface during turning movements.

The snow ski 10 shown in FIG. 1 has a generally conventional overall shape and construction adapted to incorporate the double turning edges of the present invention. More particularly, the ski 10 comprises an elongated and relatively narrow strip-like body construction formed typically from assembled laminated layers of selected metal, plastic, and/or composite materials. A boot binding structure 12 is normally mounted on the upper surface of the ski at an approximately centered fore-aft position for removably supporting a ski boot 14. The underside or bottom surface of the ski comprises a smooth and substantially uninterrupted surface which may be waxed or polished for sliding movement over a snow surface.

Figure 2:
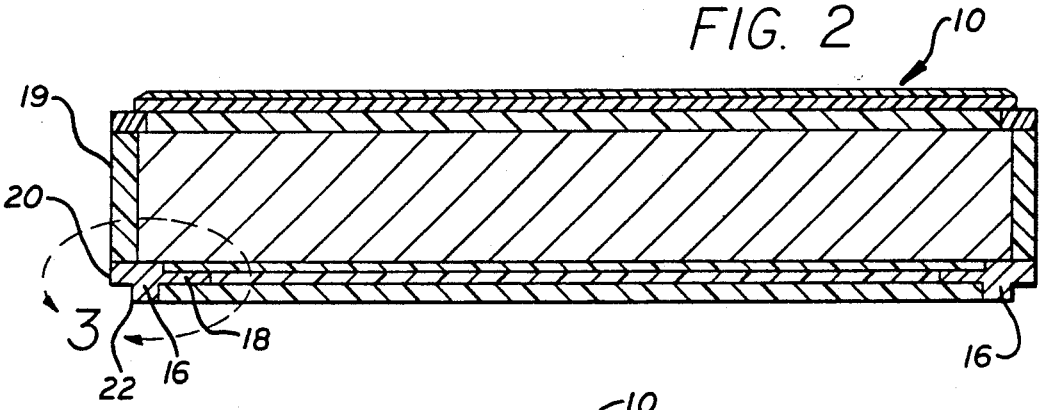
FIG. 2 is an enlarged transverse cross sectional view of the snow ski taken generally on the line 2—2 of FIG. 1.
Figure 3:
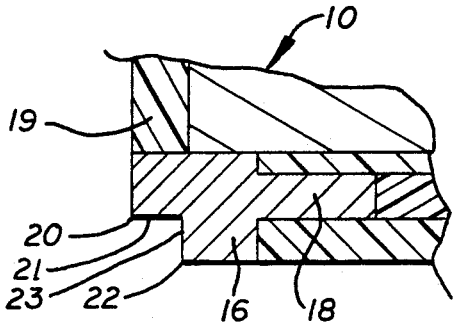
FIG. 3 is a further enlarged fragmented vertical section illustrating a portion of the snow ski generally corresponding with encircled region 3 of FIG. 2.

As shown best in FIGS. 2 and 3, an elongated edge runner 16 is mounted along the lateral and lower side edges of the ski body to extend generally in a longitudinal direction. Separate edge runners 16 may be provided respectively at the opposite sides of the ski, or a single edge runner may be provided to extend around the entire perimeter of the ski. In either case, the edge runner 16 is formed from a relatively hard material capable of defining a relatively sharp turning edge for a snow ski, with suitable metal materials such as aluminum or steel being preferred. The illustrative edge runner 16 (FIGS. 2 and 3) has an integral or one-piece construction and incorporates an appropriate mounting tongue 18 or the like for integrated lamination with other laminate layers of the ski 10 to insure a rigid and secure interconnection of the edge runner to the ski. Importantly, the edge runner 16 defines a pair of relatively sharp and longitudinally extending turning edges 20 and 22 at both lateral sides of the ski.

More specifically, each edge runner 16 is shaped to define the turning edges 20 and 22 in a laterally and vertically spaced relation to each other. FIGS. 2 and 3 show the edge 20 formed generally coplanar with a lateral side face 19 of the ski 10. This edge 20 is formed along the outboard extent of a generally horizontal spacer wall 21 (FIG. 3), wherein the spacer wall 21 is joined at an inboard edge thereof to a generally vertically extending, second spacer wall 23. The turning edge 22 is formed along the lower extent of this latter wall 23, whereby the edge 22 is disposed at a position vertically below and inset laterally inboard from the adjacent edge 20. Although the relative vertical and inboard spacing between the edges 20 and 22 may vary, typical dimensions for these spacings are on the order of 3/16ths to ⅜ths inch.

Figure 4:
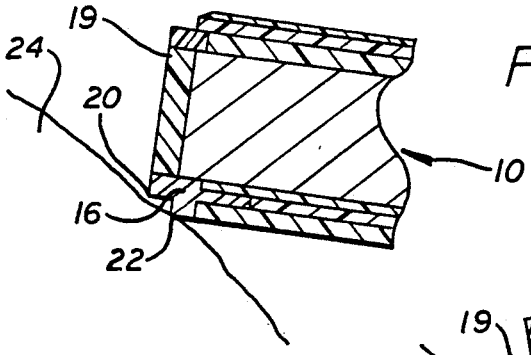
FIG. 4 is an enlarged vertical cross sectional view of the ski generally corresponding with FIG. 3, but illustrating the ski oriented for contacting one turning edge with a snow surface.
Figure 5:
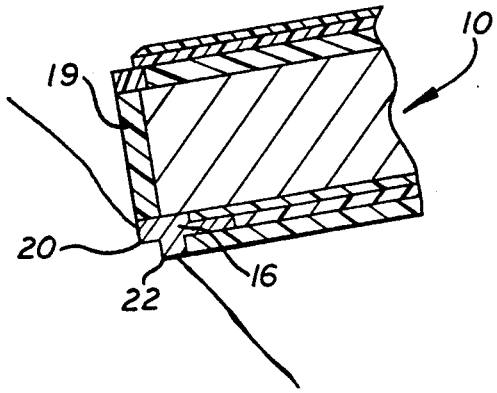
FIG. 5 is a fragmented vertical cross sectional view similar to FIG. 4, but depicting the ski oriented with both turning edges engaging the snow surface.
Figure 6:
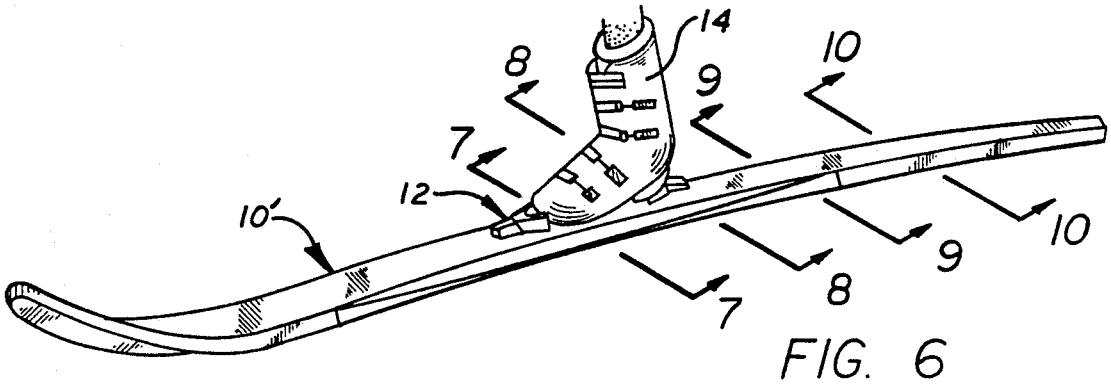
FIG. 6 is a perspective view similar to FIG. 1 but depicting one alternative preferred form of the invention.
Figure 7:
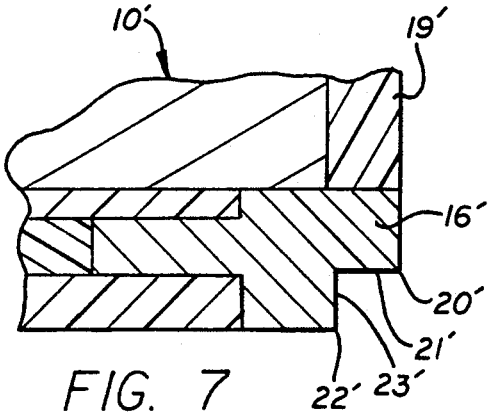
FIG. 7 is an enlarged fragmented vertical sectional view taken generally on the line 7—7 of FIG. 6.
Figure 8:
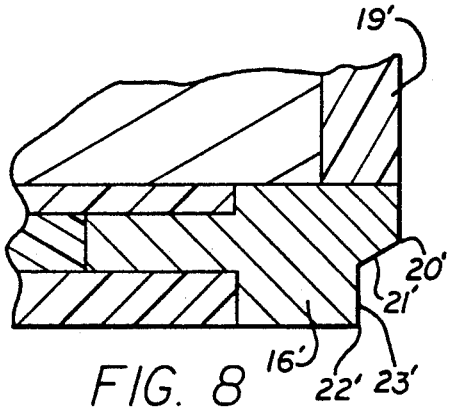
FIG. 8 is an enlarged fragmented vertical sectional view taken generally on the line 8—8 of FIG. 6.
Figure 9:
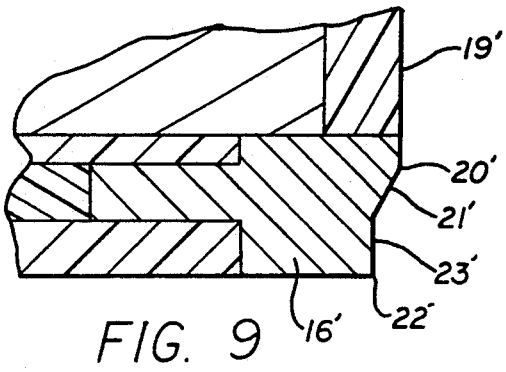
FIG. 9 is an enlarged fragmented vertical sectional view taken generally on the line 9—9 of FIG. 6.

During use of the ski 10 in the course of normal skiing movements, the ski is tilted during a turning maneuver to engage the edge runner 16 along one side of the ski with the snow surface. As viewed in FIG. 4, relatively minor tilted orientation of the ski 10 positions the lower turning edge 22 for gripping or edging contact with the snow surface 24. FIG. 5 illustrates a further tilted orientation of the ski 10 for engaging both of the turning edges 20 and 22 with the snow surface. When both of the edges 20 and 22 are engaged with the snow surface, the gripping engagement with the snow is effectively doubled to provide a major enhancement in turning maneuverability and skier control.

Figure 10:
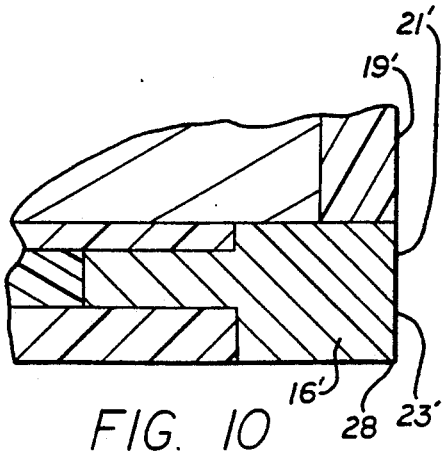
FIG. 10 is an enlarged fragmented vertical sectional view taken generally on the line 10—10 of FIG. 6.

In the embodiment of FIGS. 1–5, the double edges of 20 and 22 extend longitudinally in substantial parallel relation to each other for the entire length of the ski along each lateral side thereof. FIGS. 6–10 depict an alternative preferred form of the invention, wherein an edge runner 16' defines the double turning edges are provided along a selected portion of the lateral sides of a ski 10'. More particularly, FIGS. 6–10 illustrate the double turning edges 20' and 22' to extend over approximately one half of the overall ski length, and within a generally central region of the ski to provide the double edging action in a region adjacent to the boot binding structure 12. FIGS. 7–10 illustrate a tapering construction for the lower edge 22' as the edges 20' and 22' are blended into each other with smooth transition to a single edge 28 near the front and rear of the ski. Throughout this transition, the first or upper spacer wall 21' turns progressively from a generally horizontal orientation (FIG. 7) at the double edge region to a generally vertical orientation aligned with the side face 19' of the ski at the single edge region (FIG. 10). Similarly, the second or lower spacer wall 23' extends progressively with generally vertical orientation from the double edge portion to a position generally aligned with the ski side face 19' at the single edge portion.

A variety of further modifications and improvements to the double edge snow ski 10 of the present invention will be apparent to those skilled in the art. For example, while FIGS. 6–10 illustrate the double edge construction over a central region of the ski length, it will be understood that the double edge construction may be provided near the forward end of the ski and/or the rear end, with a single edge construction in the central region. Accordingly, no limitation on the invention is intended by way of the foregoing description and accompanying drawings, expect as set forth in the appended claims.

What is claimed is:

1. A double edge snow ski, comprising:

an elongated ski body; and an edge runner extending longitudinally along one lateral side of said ski body and including means for secure attachment thereto, said edge runner having a double edge portion defining upper and lower generally longitudinally extending turning edges, said upper turning edge being formed along a laterally outboard edge of a generally horizontally extending first spacer wall defined by said edge runner, said first spacer wall having a laterally inboard edge joined to an upper extent of a generally vertically extending second spacer wall defined by said edge runner and having said lower turning edge formed along a lower extent thereof, whereby said upper turning edge is spaced vertically above and laterally outboard of said lower turning edge;

said edge runner further including a single edge portion extending generally longitudinally along said one lateral side of said ski body;

said edge runner also defining a transition portion extending generally longitudinally along said one lateral side of said ski body at a position interposed longitudinally between said double and single edge portions, said transition portion including said first and second spacer walls extending generally horizontally and vertically, respectively, at said double edge portion, said first spacer wall turning progressively through said transition portion from the horizontal orientation at said double edge portion to a generally vertical orientation disposed generally coplanar with said upper turning edge at said single edge portion, and said second spacer wall extending with generally vertical orientation progressively in a laterally outboard direction from said double edge portion to a position generally coplanar with said first spacer wall at said single edge portion.

2. The double edge ski of claim 1 wherein said edge runner has a one-piece construction.

3. The double edge ski of claim 1 wherein said upper turning edge is disposed generally coplanar with a lateral side face defined by said ski body.

4. The double edge ski of claim 1 wherein said single edge portion extends longitudinally along a forward and a rearward region of the length of said ski body, said double edge portion extending longitudinally along a central region of the ski body length, and said transition portion comprising a pair of transition segments interposed respectively between said central and forward regions, and between said central and rearward regions.

* * * * *